US009879665B2

(12) United States Patent
Chou

(10) Patent No.: US 9,879,665 B2
(45) Date of Patent: Jan. 30, 2018

(54) PORTABLE ELECTRIC INFLATOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 272 days.

(21) Appl. No.: 14/710,425

(22) Filed: May 12, 2015

(65) Prior Publication Data

US 2015/0337825 A1 Nov. 26, 2015

(30) Foreign Application Priority Data

May 26, 2014 (TW) ..... 103118289 A

(51) Int. Cl.

| | |
|---|---|
| ***F04B 35/06*** | (2006.01) |
| ***F04B 37/18*** | (2006.01) |
| ***F04B 39/14*** | (2006.01) |
| ***F04B 53/14*** | (2006.01) |
| ***F04B 35/04*** | (2006.01) |
| ***F04B 39/06*** | (2006.01) |
| ***F04B 39/12*** | (2006.01) |
| ***F04B 53/08*** | (2006.01) |
| ***F04B 53/16*** | (2006.01) |

(52) U.S. Cl.

CPC ..... *F04B 35/06* (2013.01); *F04B 35/04* (2013.01); *F04B 37/18* (2013.01); *F04B 39/066* (2013.01); *F04B 39/121* (2013.01); *F04B 39/14* (2013.01); *F04B 53/08* (2013.01); *F04B 53/14* (2013.01); *F04B 53/16* (2013.01)

(58) Field of Classification Search

CPC ..... F04B 39/14; F04B 39/066; F04B 39/121; F04B 35/06; F04B 35/04; F04B 53/22; F04B 53/08; F04B 53/16; F04D 25/0673; F04D 25/082; F04D 29/522; F04D 29/403; F04D 29/601; Y10T 403/599; Y10T 403/606

See application file for complete search history.

(56) References Cited

U.S. PATENT DOCUMENTS 5,803,651 A * 9/1998 Saito ..... H01R 13/641 403/11

2002/0009372 A1* 1/2002 Gruber ..... F02B 63/02 417/234

FOREIGN PATENT DOCUMENTS

EP 2353848 * 8/2011

* cited by examiner

*Primary Examiner* — Devon Kramer
*Assistant Examiner* — Kenneth J Hansen

(57) ABSTRACT

A portable electric inflator includes an electric air compressor, a pressure gauge, and a box for accommodating the electric air compressor and the pressure gauge. The box defines therein a generally L-shaped space for accommodating a cooling fan, a motor, a main frame with a transmission mechanism, a cylinder with a piston body, and an air storage tank of the electric air compressor. The motor defines two openings at its surrounding wall and multiple downstream through holes at its bottom wall. The main frame is provided with a peripheral wall and beveled radial braces and defines two through holes to facilitate the airflow passing through the main frame. The cooling fan can draw outside air to enter the box and smoothly flow along the generally L-shaped space to quickly dissipate the heat generated by the electric air compressor, whereby the performance and safety of the inflator can be increased.

8 Claims, 12 Drawing Sheets

PORTABLE ELECTRIC INFLATOR

(a) TECHNICAL FIELD OF THE INVENTION

The present invention relates to a portable electric inflator that includes an electric air compressor and a box, composed of a cover and a base, for accommodating the electric air compressor and the pressure gauge in separate spaces, wherein the box defines therein a generally L-shaped space to accommodate various parts of the air compressor; in operation, a cooling fan of the air compressor can draw outside air into the generally L-shaped space, the airflow being directed to flow through two openings of the motor to enter the interior of the motor so that the heat generated in the motor can be quickly dissipated; the airflow is guided to a peripheral wall of a main frame of the air compressor, which cooperates with a plurality of beveled radial braces around a bearing, and two through holes of the main frame to facilitate the airflow to flow through the main frame to quickly dissipate the heat generated in the bearing and the associated transmission mechanism; the airflow passing through the main frame turns at a right angle to reach the cylinder fitted with a piston body to quickly dissipate the heat generated from the reciprocating motion of the piston body, whereby the performance of the inflator can be increased, so that the time required for inflating an object can be reduced.

(b) DESCRIPTION OF THE PRIOR ART

Air compressors are a device that can be used to inflate an object, such as an air cushion or a tire. They are usually made in compact size for easy transportation. Furthermore, they can be powered by a handheld DC supply or connected to a cigarette lighter socket for an operation. Conventionally, an air compressor includes an air compressor and a box for accommodating the air compressor, wherein the air compressor includes a motor for driving a piston body to conduct reciprocating motion along the inner space of a cylinder for producing compressed air, which can be stored in an air storage tank provided with outlets, one of which can be connected with a hose to inflate an object. However, the reciprocating motion of the piston body usually generates a lot of heat in the box. If the heat cannot be effectively dissipated, the performance and safety of the air compressor will be reduced.

Thus, there is a need to provide a portable electric inflator, including an air compressor and a box, which can mitigate the drawback of the conventional air compressor, wherein the heat generated by the air compressor of the inflator can be effectively dissipated, so that the performance and safety of the inflator can be increased and thus the time required for inflating an object can be reduced.

SUMMARY OF THE INVENTION

One object of the present invention is to provide a portable electric inflator that includes an electric air compressor, a pressure gauge, and a box for accommodating the electric air compressor and the pressure gauge in separate spaces, wherein the box defines therein a generally L-shaped space for accommodating various parts of the electric air compressor, whereby outside air can be drawn by a cooling fan of the air compressor to smoothly flow along the generally L-shaped space to quickly dissipate the heat generated by the electric air compressor, so that the performance and safety of the inflator can be increased.

According to one aspect of the present invention, the box of the portable electric inflator is composed of a cover and a base. The cover and the base are provided with a plurality of partitioning walls to define the generally L-shaped space, which facilitates the airflow drawn by the cooling fan to reach a cylinder fitted with a piston body, wherein one part of the airflow may flow over the cylinder to dissipate the heat of the cylinder; another part of the airflow may flow through an intake channel of the piston body to enter the inner space of the cylinder, so that the heat of the cylinder can be dissipated more quickly.

According to another aspect of the present invention, the air compressor includes a main frame for mounting the motor and supporting the cylinder, wherein the main frame defines two through holes and is provided with a peripheral wall being partially around a bearing, and a plurality of beveled radial braces provided between the peripheral wall and a portion that holds the bearing to facilitate the airflow flowing through the main frame, thus effectively dissipating the heat generated in the bearing and the associated transmission mechanism.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
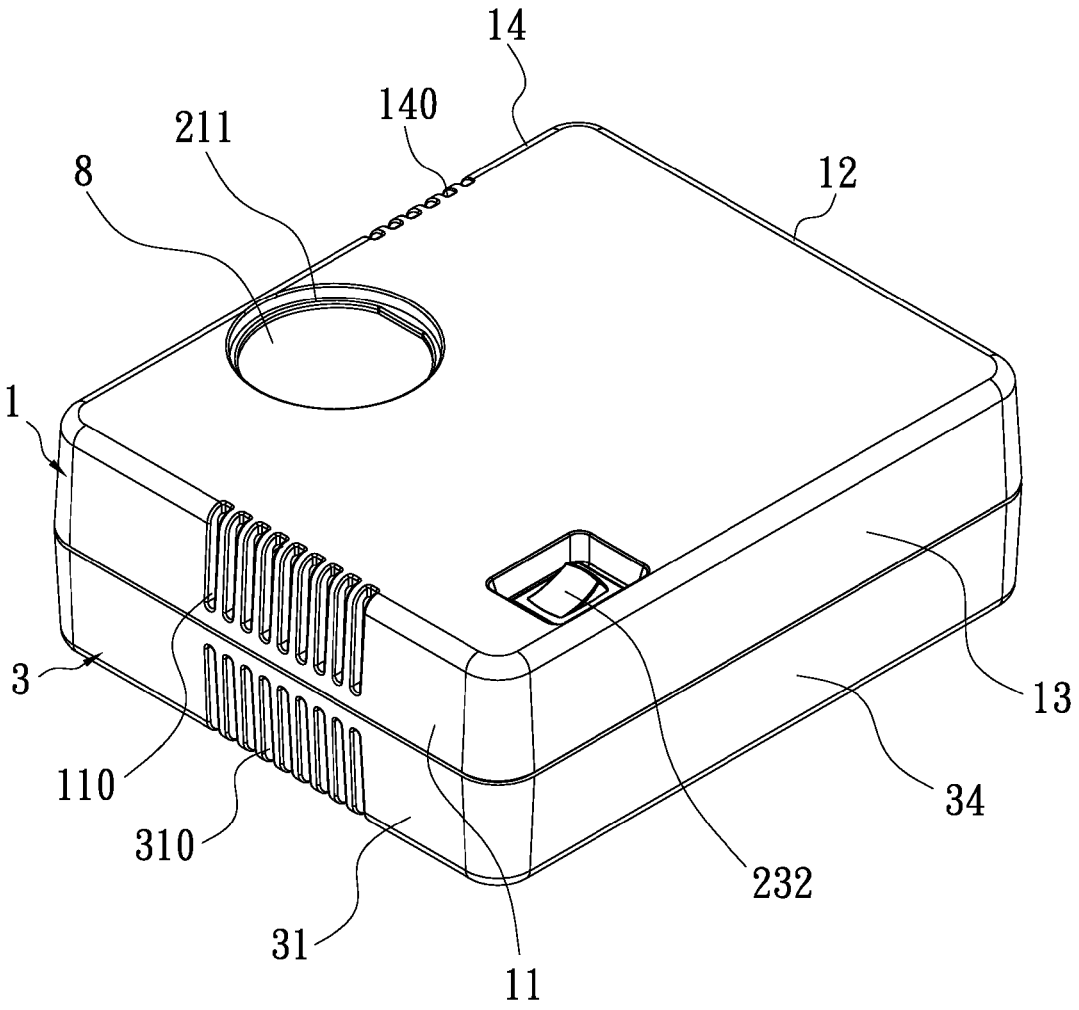
FIG. 1 shows a 3-dimensional view of a portable electric inflator according to one embodiment of the present invention, wherein an electric air compressor is accommodated in a box that is composed of a cover and a base.
Figure 3:
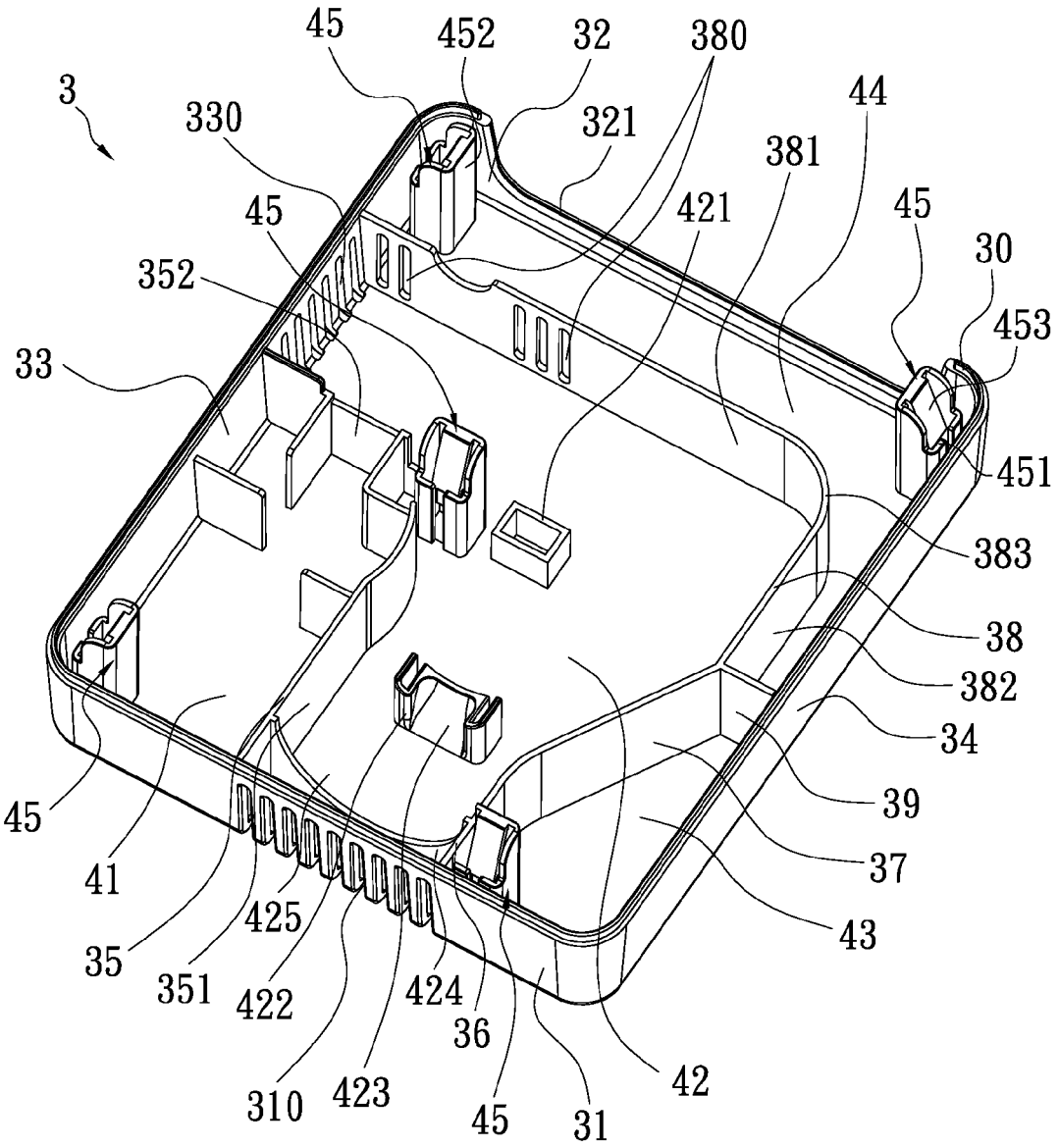
FIG. 3 shows a 3-dimensional view of the base of the box.
Figure 4:
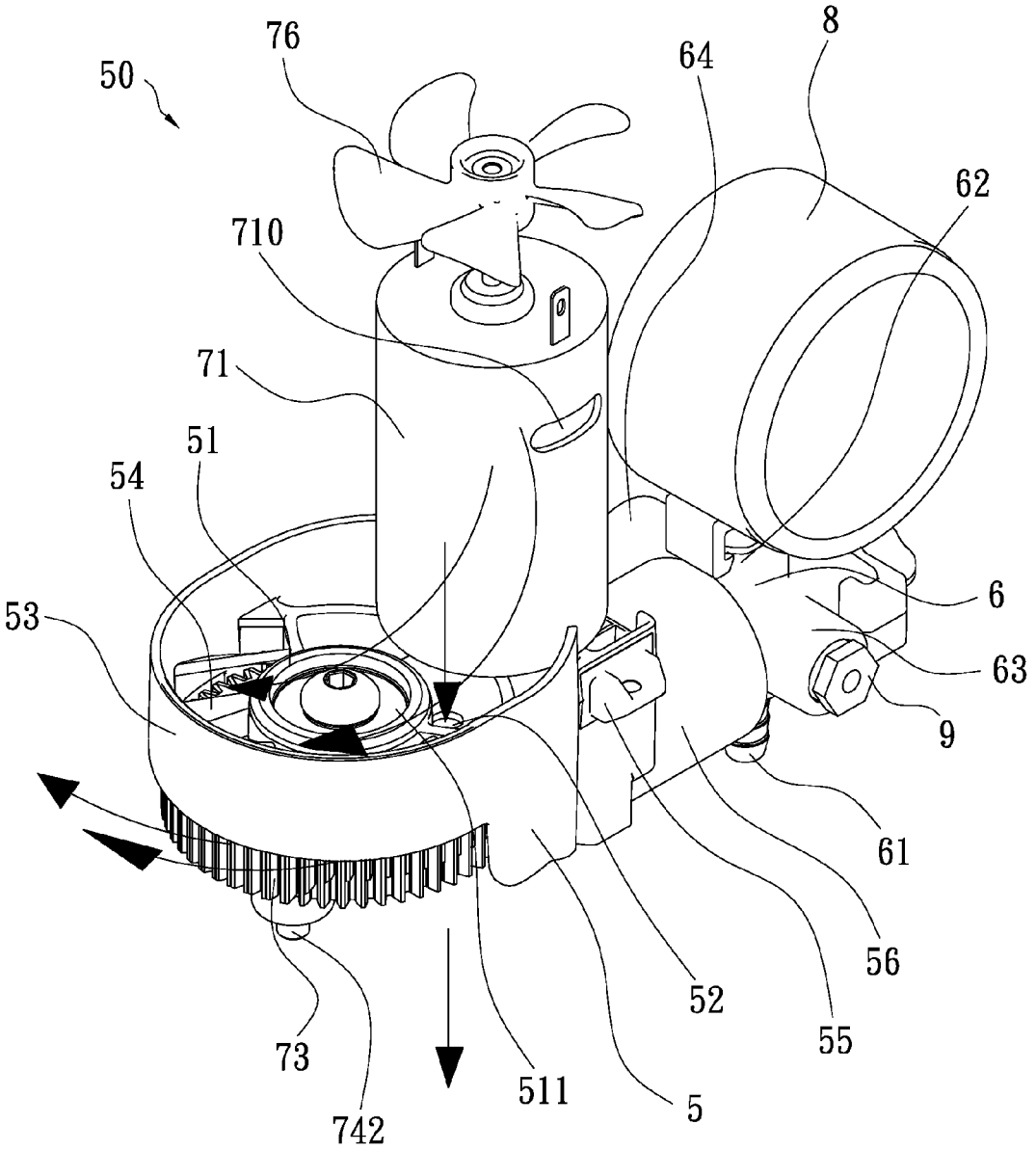
FIG. 4 shows a 3-dimensional view of the electric air compressor.

Referring first to FIGS. 1 and 4, a portable electric inflator according to one embodiment of the present invention is shown, which generally comprises an electric air compressor 50, a pressure gauge 8, and a box for accommodating the electric air compressor 50 and the pressure gauge 8. The box is composed of a cover 1 and a base 3. The cover 1 is provided with a switch 232, a transparent window 211 above the pressure gauge 8, and a plurality of upper snap fasteners 25 (see FIG. 2). The switch 232 is electrically connected to the electric air compressor 50 for starting/stopping an operation. The transparent window 211 allows a user to read the pressure gauge 8 that indicates the pressure of the compressed air produced in the electric air compressor 50. The electric air compressor 50 includes a main frame 5, a cylinder 56 fitted with a piston body 75 and provided at the main frame 5 (see FIG. 6), a motor 71 fitted with a cooling fan 76 at its output axle and mounted to the main frame 5. The motor 71 can rotate the cooling fan 76 and drive a transmission mechanism to have the piston body 75 conduct reciprocating motion in the cylinder 56, so that compressed air is produced in the cylinder 56 and transferred to an air storage container 6 provided with a plurality of outlets 61, 62, 63, 64. The box is rectangular in shape (see FIG. 2). The cover 1 has a flat top and four sidewalls including a front wall 11, a rear wall 12, a right wall 13, and a left wall 14. The front wall 11 defines a plurality of first slits 110, which serve as an air entrance port to allow outside air to flow into the interior of the box. The left wall 14 defines a plurality of second slits 140, which serve as an air exit port to allow the air within the box to flow out of the box. The cover 1 is provided with a plurality of upper partitioning walls, which divide the interior of the cover 1 into a number of upper spaces. The base 3 has a flat bottom and four sidewalls (see FIG. 3), which includes a front wall 31, a rear wall 32, a right wall 34, and a left wall 33. The front wall 31 defines a plurality of first slits 310, which serves as an air entrance port to allow outside air to flow into the interior of the box in addition to the first slits 110 of the cover 1. The left wall 33 defines a plurality of second slits 330, which serve as an air exit port to allow the air within the box to flow out of the box in addition to the second slits 140 of the cover 1. The base 3 is provided with a plurality of lower partitioning walls, corresponding to the upper partitioning walls of the cover 1, which divide the interior of the base 3 into a number of lower spaces, which cooperates with the corresponding upper spaces of the cover 1 for accommodating various parts of the electric air compressor 50 and the pressure gauge 8, which will be illustrated in detail in the following paragraphs.

Figure 5:
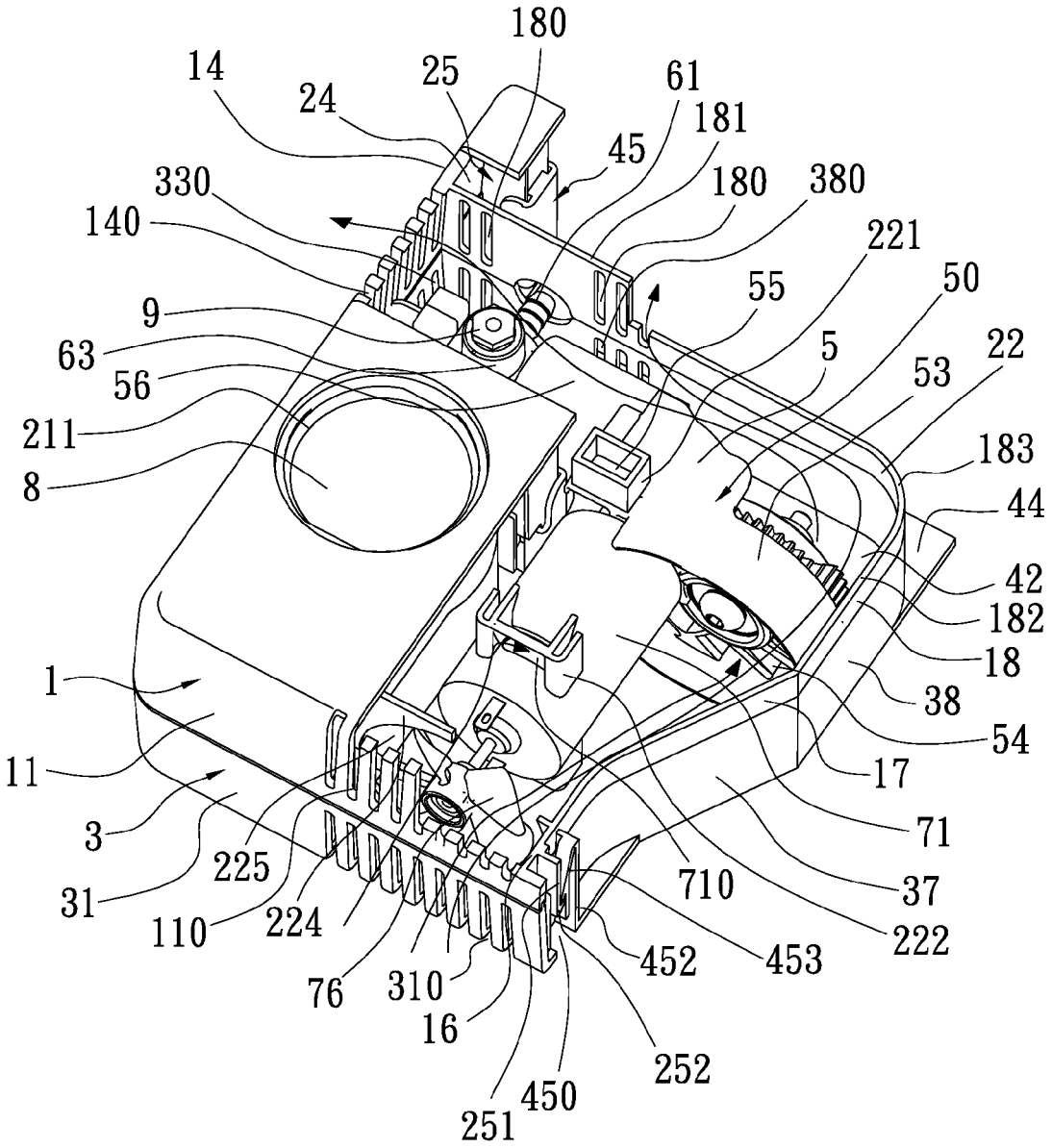
FIG. 5 shows a 3-dimensional working view of the inflator, wherein outside air is introduced into a generally L-shaped space defined in the box.

One advantage of the present invention is that the heat generated by the electric air compressor 50 can be quickly dissipated. As shown in FIG. 5, outside air is drawn by the cooling fan 76 to flow through the first slits 110, 310 to enter the interior of the box and finally flow out of the box via the second slits 140, 330. As such, the heat generated by various parts of the electric air compressor 50 can be taken away with the airflow, so that the performance of the inflator can be increased, and thus the time required for inflating an object can be shorten. Furthermore, the size of the portable electric inflator can be reduced.

As shown in FIG. 3, the lower partitioning walls include a first L-shaped wall 35, a short straight wall 36, an outwardly angled wall 37, a second L-shaped wall 38, and a short transverse wall 39. The first L-shaped wall 35 is generally composed of a first straight part 352 and a second straight part 351. The second L-shaped wall 38 is generally composed of a first straight part 381, a second straight part 382, and a curved part 383 therebetween. The first straight part 352 of the first L-shaped wall 35 is joined to the left wall 33. The second straight part 351 of the first L-shaped wall 35 is joined to the front wall 31. The first straight part 381 of the second L-shaped wall 38 is joined to the left wall 33. One end of the outwardly angled wall 37 is joined to the second straight part 382 of the second L-shaped wall 38. The short straight wall 36 is joined between the front wall 31 and the other end of the outwardly angled wall 37. The short transverse wall 39 is joined between the right wall 34 and the junction of the outwardly angled wall 37 and the second L-shaped wall 38. The front wall 31, the left wall 33, and the first L-shaped wall 35 define a first space 41 within the base 3. The front wall 31, the first L-shaped wall 35, the left wall 33, the second L-shaped wall 38, the outwardly angled wall 37, and the short straight wall 36 define a second space 42 within the base 3. The front wall 31, the right wall 34, the short transverse wall 39, the outwardly angled wall 37, and the short straight wall 36 define a third space 43 within the base 3. The right wall 34, the rear wall 32, the left wall 33, the second L-shaped wall 38, and the short transverse wall 39 define a fourth space 44 within the base 3. The flat bottom of the base 3 is provided with a lower positioning socket 421 and a lower airflow-guiding member 422 within the second space 42, wherein the lower airflow-guiding member 422 is provided with a slant surface 423.

Figure 2:
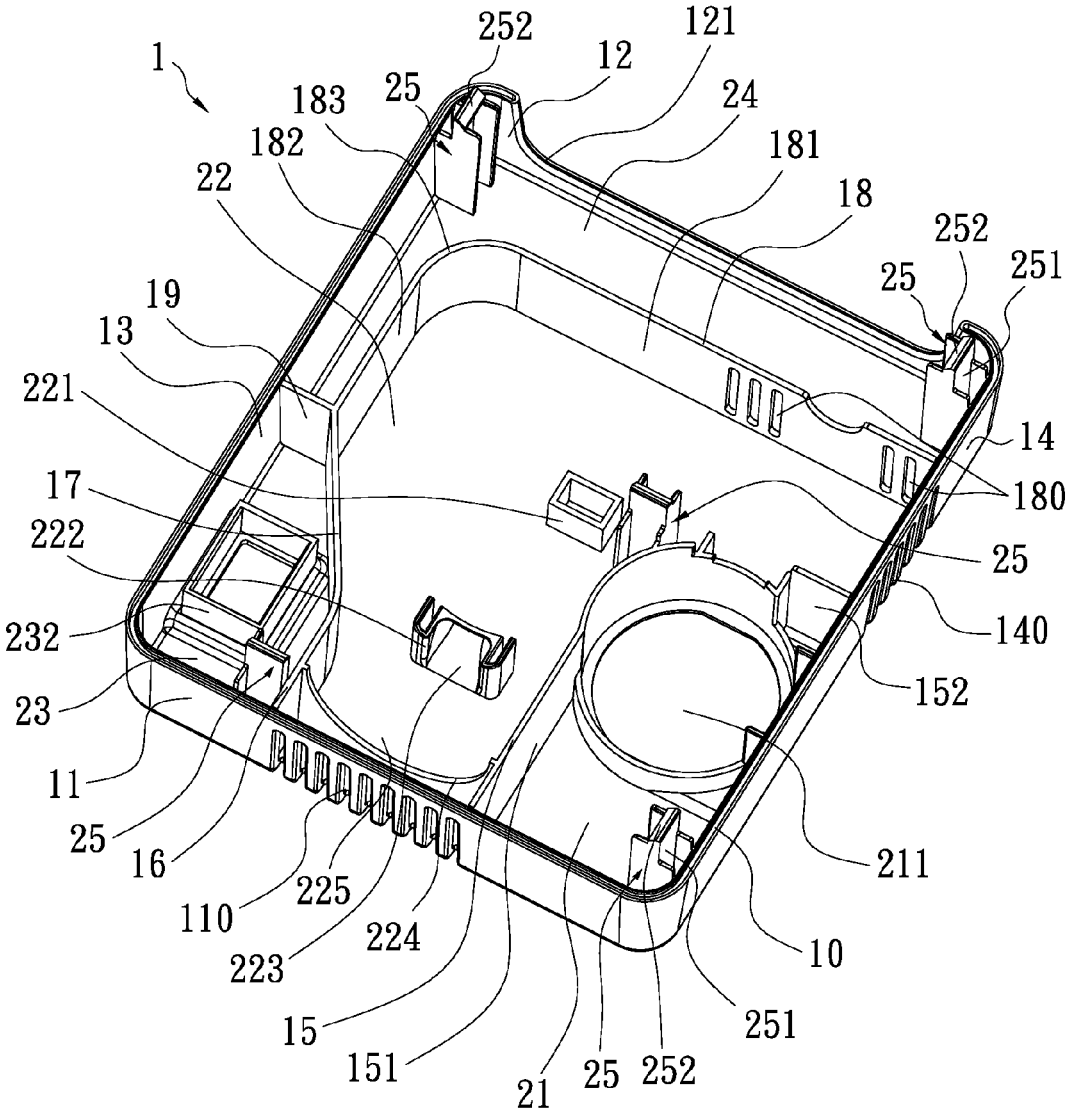
FIG. 2 shows a 3-dimensional view of the cover of the box.

As shown in FIG. 2, the upper partitioning walls include a first L-shaped wall 15, a short straight wall 16, an outwardly angled wall 17, a second L-shaped wall 18, and a short transverse wall 19 respectively corresponding to the first L-shaped wall 35, the short straight wall 36, the outwardly angled wall 37, the second L-shaped wall 38, and the short transverse wall 39 of the base 3. The first L-shaped wall 15 is generally composed of a first straight part 152 and a second straight part 151. The second L-shaped wall 18 is generally composed of a first straight part 181, a second straight part 182, and a curved part 183 therebetween. The first straight part 152 of the first L-shaped wall 15 is joined to the left wall 14. The second straight part 151 of the first L-shaped wall 15 is joined to the front wall 11. The first straight part 181 of the second L-shaped wall 18 is joined to the left wall 14. One end of the outwardly angled wall 17 is joined to the second straight part 182 of the second L-shaped wall 18. The short straight wall 16 is joined between the front wall 11 and the other end of the outwardly angled wall 17. The short transverse wall 19 is joined between the right wall 13 and the junction of the outwardly angled wall 17 and the second L-shaped wall 18. The front wall 11, the left wall 14, and the first L-shaped wall 15 define a first space 21 within the cover 1. The front wall 11, the first L-shaped wall 15, the left wall 14, the second L-shaped wall 18, the outwardly angled wall 17, and the short straight wall 16 define a second space 22 within the cover 1. The front wall 11, the right wall 13, the short transverse wall 19, the outwardly angled wall 17, and the short straight wall 16 define a third space 23 within the cover 1 for mounting the switch 232. The right wall 13, the rear wall 12, the left wall 14, the second L-shaped wall 18, and the short transverse wall 19 define a fourth space 24 within the cover 1. The flat top of the cover 1 is provided with a top positioning socket 221 and an upper airflow-guiding member 222 within the second space 22, wherein the upper airflow-guiding member 222 is provided with a slant surface 223. The first space 21 of the cover 1 combines with the first space 41 of the base 3 to form a generally rectangular space for accommodating the pressure gauge 8. The second space 22 of the cover 1 combines with the second space 42 of the base 3 to form a generally L-shaped space for accommodating various parts of the electric air compressor 50, wherein the cooling fan 76 is generally located between the second straight part 351 of the first L-shaped wall 35 and the short straight wall 36; the motor 71 is generally located between the second straight part 351 of the first L-shaped wall 35 and the outwardly angled wall 37; the main frame 5 together with the transmission mechanism is located near the curved part 383 of the second L-shaped wall 38; the cylinder 56 and the air storage tank 6 are generally located between the first straight part 352 of the first L-shaped wall 35 and the first straight part 381 of the second L-shaped wall 38; the piston 75 is parallel to the first straight part 381 of the second L-shaped wall 38.

Figure 8:
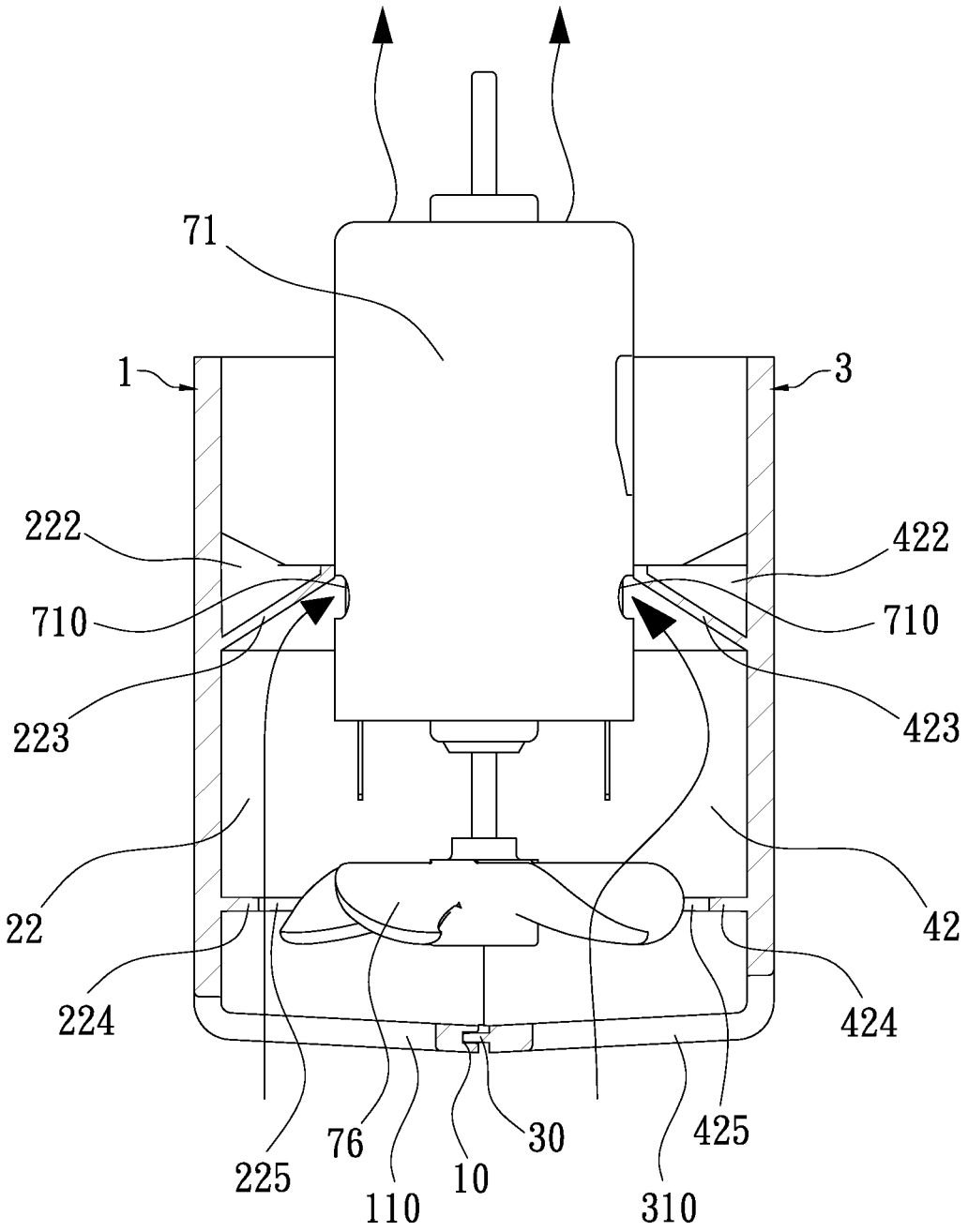
FIG. 8 shows an enlarged sectional working view of a motor used in the electric air compressor, wherein two airflow-guiding members facilitate the airflow to enter the interior of the motor to dissipate the heat generated in the motor.
Figure 9:
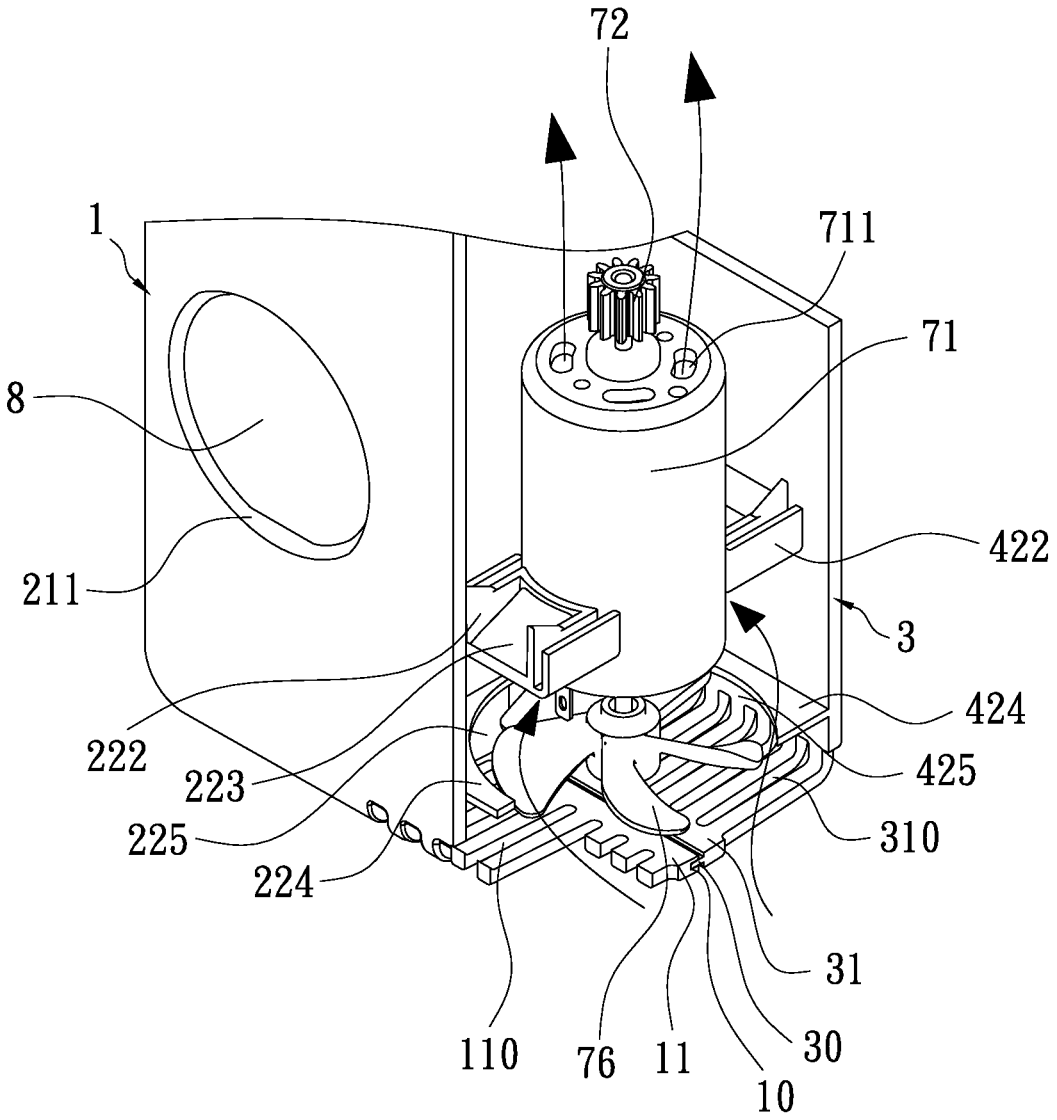
FIG. 9 shows an enlarged 3-dimensional working view of the motor.

The motor 71 defines two openings 710 at its surrounding wall and a plurality of downstream through holes 711 at its bottom wall opposite to the cooling fan 76 (see FIGS. 8 and 9), corresponding to the upper and lower airflow-guiding members 222, 422 provided at the box. The frame 5 is provided with two protrusions 55 corresponding to the sockets 221, 421 provided at the box. The electric air compressor 50 is placed in the box such that the upper and lower positioning sockets 221, 421 are respectively engaged with the two protrusions 55 provided on the electric air compressor 50 to prevent the air compressor from tilting or turning over. More specifically, the upper and lower airflow-guiding members 222, 422 are arranged such that each of the slant surfaces 223, 423 thereof being directed towards one of the openings 710 of the motor 71, so that the airflow drawn by the cooling fan 76 can flow through the openings 710 of the motor 71 to enter the interior of the motor 71 and finally flow out of the motor 71 via the downstream through holes 711 to quickly dissipate the heat generated in the motor 71.

Figure 6:
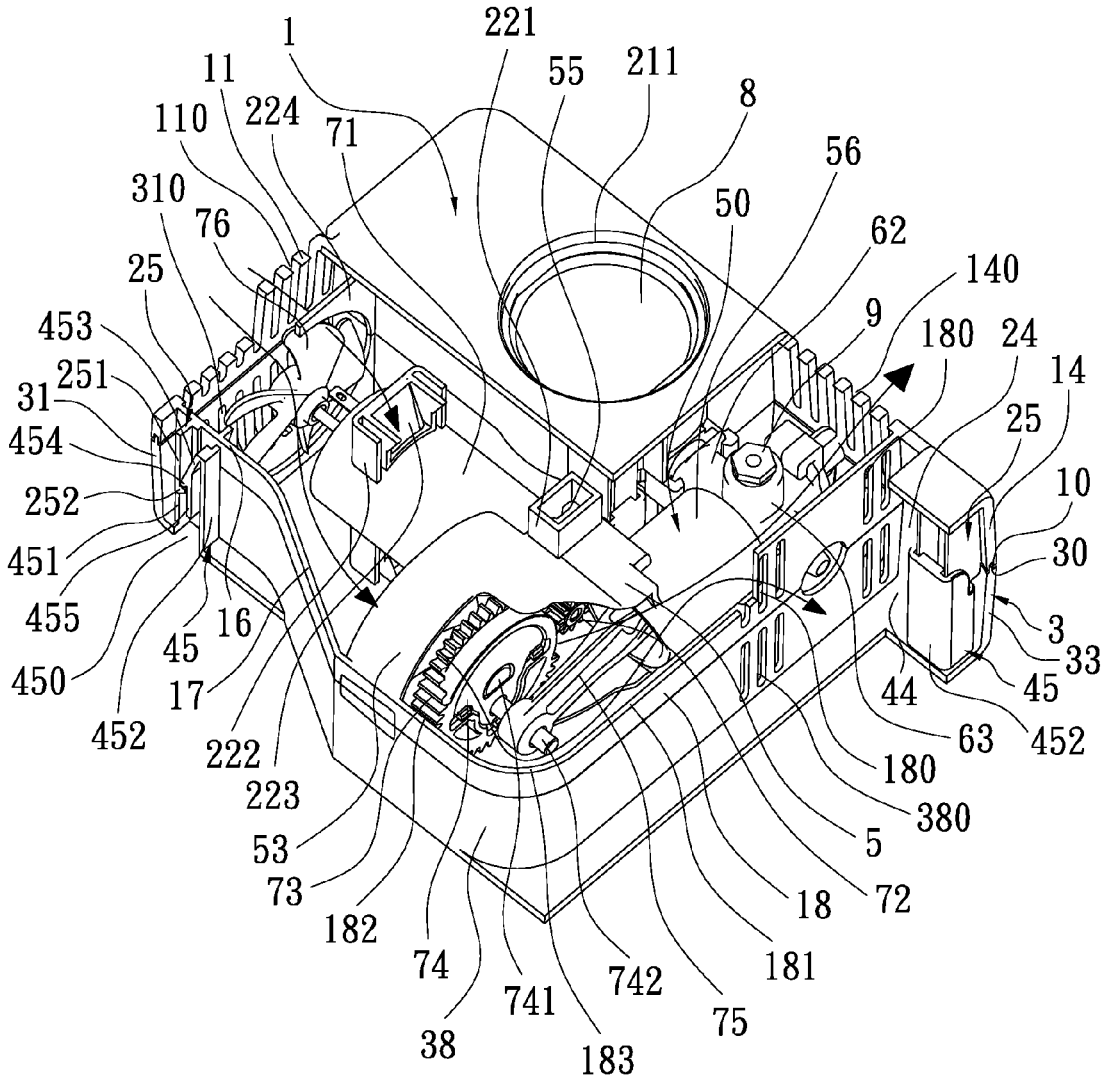
FIG. 6 shows another 3-dimensional working view of the inflator, wherein outside air is introduced into the generally L-shaped space defined in the box.
Figure 10:
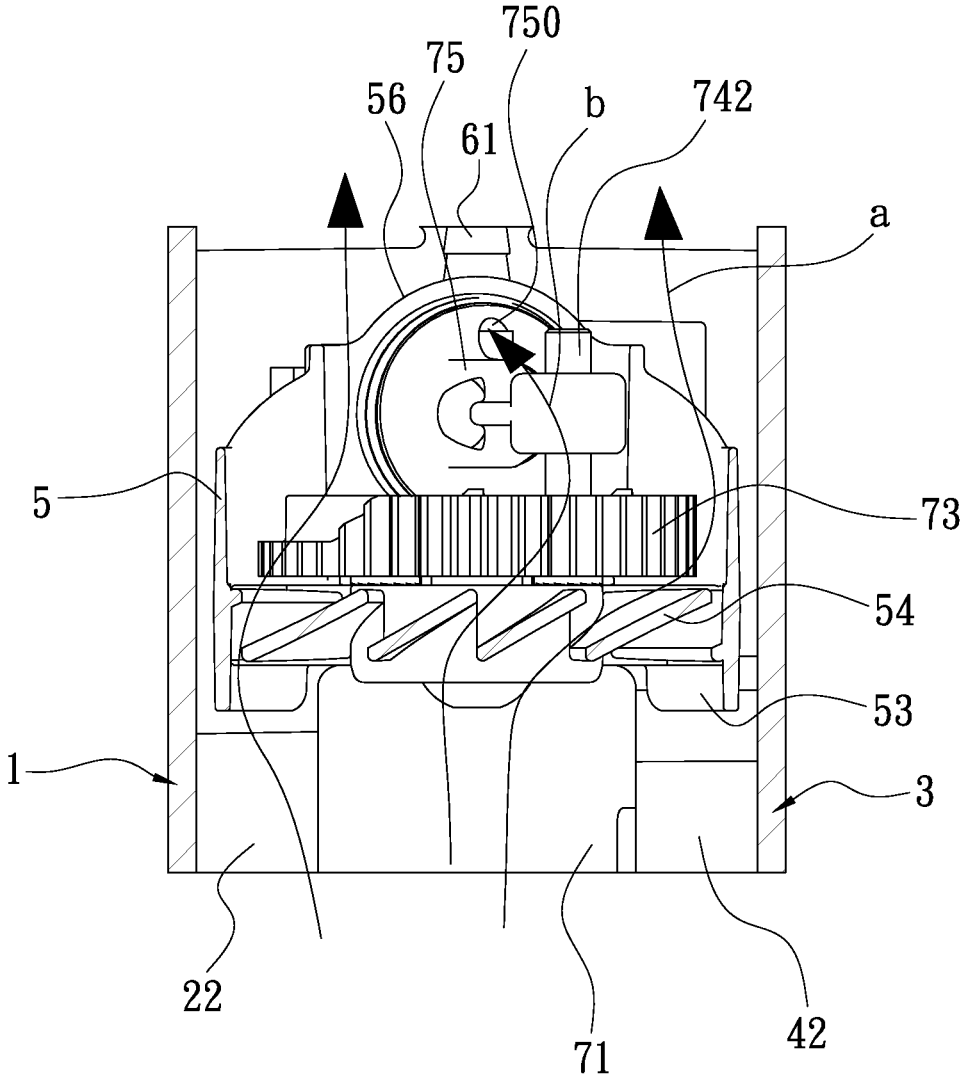
FIG. 10 shows an enlarged sectional working view of the main frame of the air compressor, wherein the airflow is introduced through the main frame.

The transmission mechanism includes a pinion 72 fitted at the output axle of the motor 71, a gear 73 engaged with the pinion 72, and a counterweight 74 provided with a crankshaft 741 and a crankpin 742 and attached to the gear 73 (see FIG. 6). The main frame 5 defines two axle-supporting portions 51, one of which is for mounting the motor 71, and the other of which is provided with a bearing 511 for mounting with the crankshaft 741 provided at the counterweight 74. The crankpin 742 is pivotally connected to the piston body 75. The airflow drawn by the cooling fan 76 can flow over the cylinder 56 to dissipate the heat therein, as indicated by the flow path (a) in FIG. 7. In addition, the piston body 75 defines an intake channel 750 (see FIG. 10), which allows the airflow drawn by the cooling fan 76 to flow into the inner space of the cylinder 56, indicated by the flow path (b) in FIG. 7, so that the heat generated in the cylinder 56 can be dissipated more quickly. The main frame 5 defines two through holes 52 at two opposite sides of the axle-supporting portions 51. The main frame 5 has a peripheral wall 53 being partially around the bearing 511, and a plurality of beveled radial braces 54 provided between the peripheral wall 53 and the axle-supporting portion that holds the bearing 511 to facilitate the airflow to flow through the main frame 5 and thus dissipate the heat generated in the bearing 511 and the transmission mechanism. The air storage tank 6 is provided with a plurality of outlets 61, 62, 63, 64 for connecting to different objects, wherein the outlet 61 can be connected with a hose (not shown), the outlet 62 is connected with the pressure gauge 8, and the outlet 63 is connected with a safety valve 9.

Furthermore, the cover 1 is provided with an upper wall 224 behind the front wall 11 thereof, between the first L-shaped wall 15 and the short straight wall 16 of the cover 1, wherein the upper wall 224 has a concave bottom edge. The base 3 is provided with a lower wall 424 behind the front wall 31 thereof, between the first L-shaped wall 35 and the short straight wall 36 of the base 3, wherein the lower wall 424 has a concave top edge. Thus, the upper wall 224 and the lower wall 424 define therebetween a round opening that is composed of an upper part 225 and a lower part 425. The round opening has a dimension slightly greater than the cooling fan 76, and thus can receive the cooling fan 76. Such a design can reduce the turbulence of the airflow being drawn into the generally L-shaped space (see FIG. 8).

Figure 7:
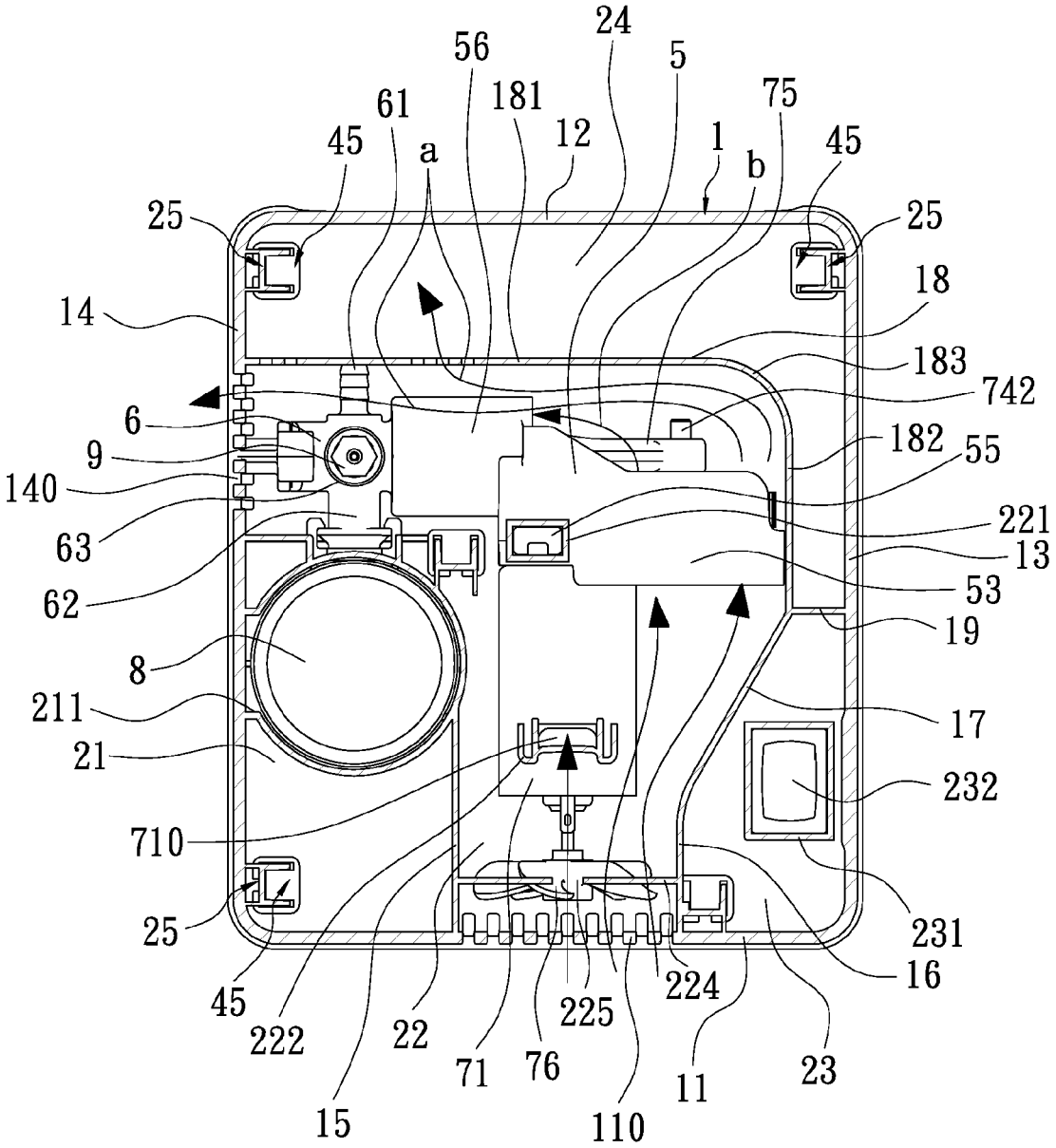
FIG. 7 shows a sectional working view of the inflator, wherein outside air is introduced into the generally L-shaped space defined in the box.

FIGS. 5 through 7 show the path of the airflow passing through the box. In operation, the motor 71 rotates the cooling fan 76 to draw outside air to sequentially flow through the first slits 110, 310 of the front walls 11, 31 and the round opening defined between the upper wall 224 and the lower wall 424. This design allows outside air to be smoothly introduced into the generally L-shaped space formed by the upper space 22 of the cover 1 and the lower space 42 of the base 3, so that air turbulence can be reduced (see FIG. 8). Furthermore, the airflow-guiding members 222, 422 are substantially placed over the openings 710 of the motor 71 such that the slant surfaces 223, 423 thereof will guide the airflow to flow through the openings 710 of the motor 71 to enter the interior of the motor 71 and finally flow out of the motor 71 via the downstream through holes 711 thereof (see FIG. 9), so that the heat generated in the motor 71 can be dissipated more quickly, so that the service life of the motor 71 can be prolonged. Additionally, the short straight walls 16, 36 and the outwardly angled wall 17, 37 can guide the airflow to reach the peripheral wall 53 of the main frame 5. Thereafter, the beveled radial braces 54 can facilitate the airflow, which is a generally spiral flow, to flow through the main frame 5 (see FIG. 10), and thus dissipate the heat generated in the bearing 511 and the transmission mechanism. Furthermore, the through holes 52 of the main frame 5 can assist the airflow to flow through the main frame 5. Thereafter, the second L-shaped walls 18, 38 can guide the airflow to reach the cylinder 56, wherein one part of the airflow may flow over the cylinder 56, as indicated by the flow path (a) in FIG. 7, and finally flow out of the generally L-shaped space via the second slits 140 of the left wall 14 of the cover 1, the second slits 330 of the left wall 33 of the base 3, the third slits 180 of the second L-shaped wall 18 of the cover 1, or the third slits 380 of the second L-shaped wall 38 of the base 3, to dissipate the heat of the cylinder 56; another part of the airflow may flow through the intake channel 750 of the piston body 75 to enter the inner space of the cylinder 56 (see FIGS. 7 and 10), as indicated by the flow path (b), so that the heat generated in the cylinder 56 can be dissipated more quickly.

Figure 11:
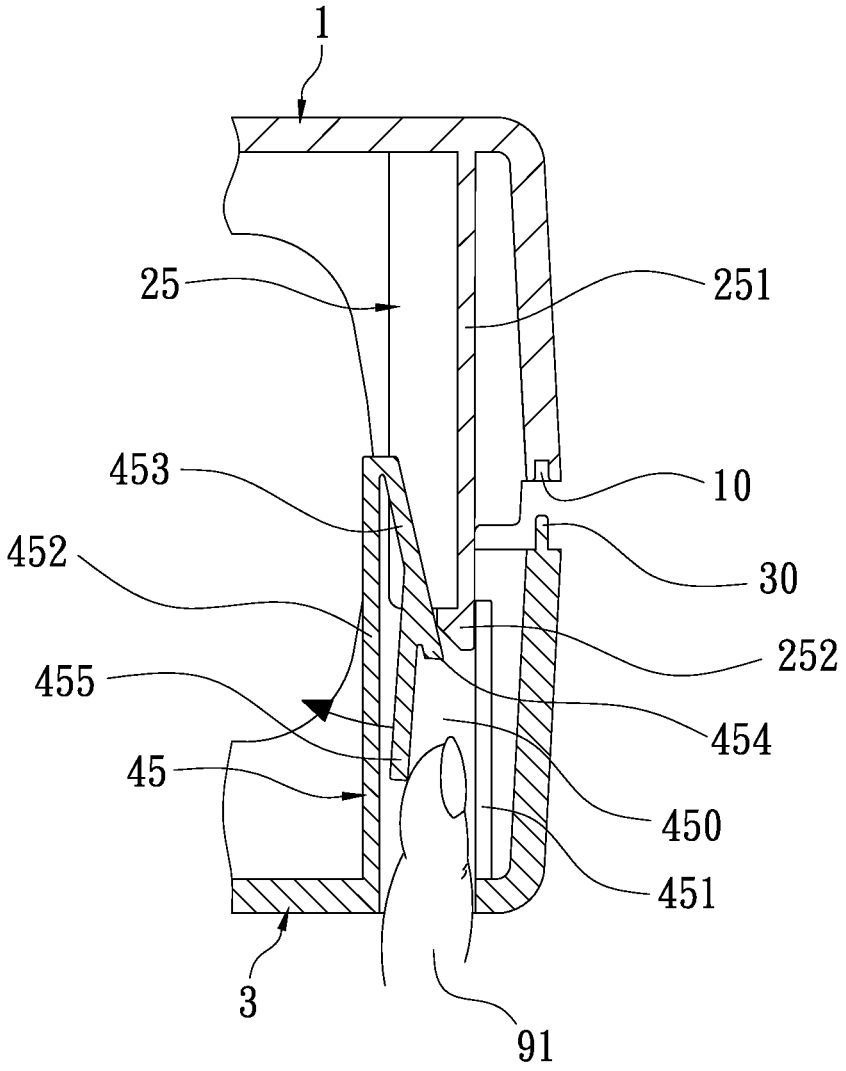
FIG. 11 shows an enlarged sectional working view of the upper and lower snap fasteners used in the cover for fixing the cover onto the base.
Figure 12:
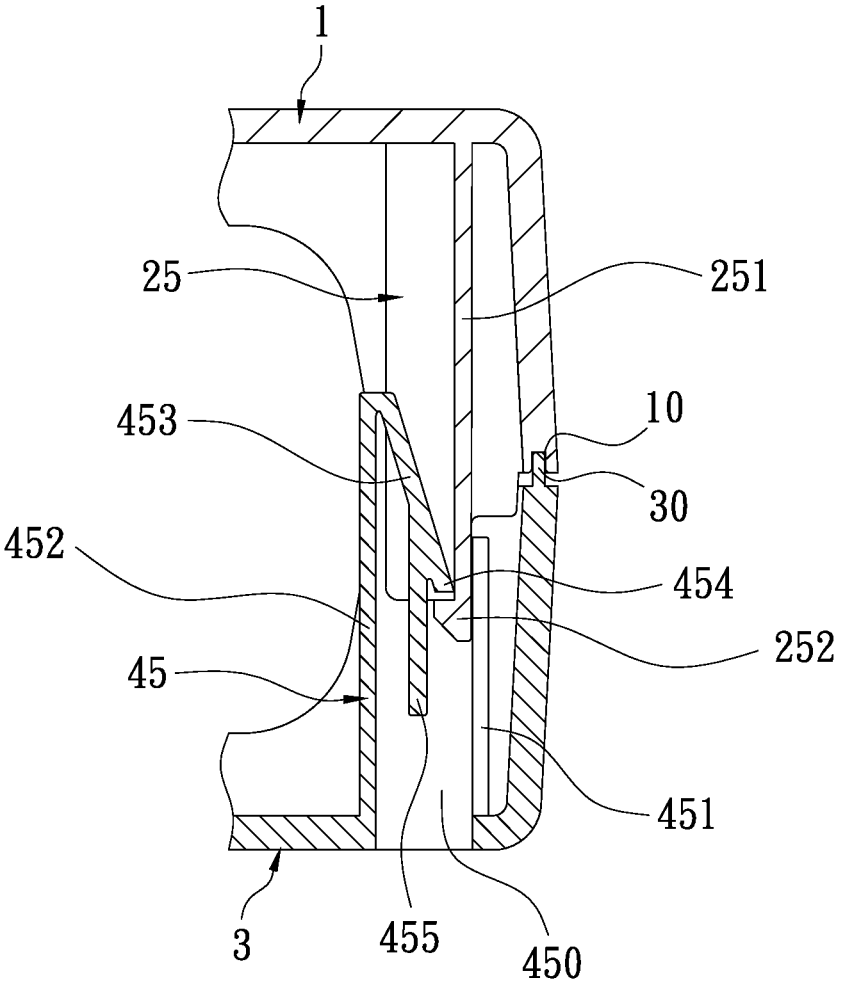
FIG. 12 shows an enlarged sectional view of the upper and lower snap fasteners, wherein the upper snap fastener is detachably engaged with the lower snap fastener.

As described above, the flat top of the cover 1 is provided with a plurality of upper snap fasteners 25 (see FIG. 2); the flat bottom of the base 3 is provided with a plurality of lower snap fasteners 45 (see FIG. 3), corresponding to the upper snap fasteners 25. As shown in FIG. 11, each of the upper snap fasteners 25 has a reinforced bar 251 extending downwardly from the flat top of the cover 1 and provided with a first hook 252 at its lower end. Each of the lower snap fasteners 45 is formed as a rectangular hollow body extending upwardly from the flat bottom of the base 3, wherein the rectangular hollow body has four side walls and defines a through hole 450 between the walls, corresponding to the upper snap fastener 25. As shown in FIG. 11, the rectangular hollow body has a first wall 451 and a second wall 452 opposite to the first wall 451, wherein the first wall 451 is short and serves as a guide for receiving the corresponding upper snap fastener 25. The second wall 452 is provided with a slant piece 453 extending downwardly from the top to the through hole 450. Thus, the slant piece 453 has a resilient characteristic, wherein the slant piece 453 is provided with a vertical piece 455 near its free end, thus forming a second hook 454 at the free end. As such, each of the upper snap fasteners 25 can be inserted into the through hole 450 of one of the lower snap fasteners 45, wherein the first wall 451 of a lower snap fastener 45 can assist a corresponding upper snap fastener 25 to push the slant piece 453 of the lower snap fastener 45 to move towards the second wall 452 of the lower snap fastener 45 to have the first hook 252 engaged with the second hook 454 (see FIG. 12), so that the cover 1 can be quickly and detachably fixed onto the base 3. Furthermore, the cover 1 defines a groove 10 along the bottom edges of its front wall 11, right wall 13, and left wall 14, whereas the base 3 is provided with a protrusion 30 along the top edges of its front wall 31, right wall 34, and left wall 33, corresponding to the groove 10 of the cover 1, wherein the protrusion 30 of the base 3 is capable of inserting into the groove 10 of the cover 1 to facilitate the cover 1 being fixed onto the base 3. For unfixing the cover 1 from base 3, a user may use a finger 91 or a pusher into the through hole 450 of each lower snap fastener 45 to press the vertical piece 455 for disengaging the second hook 454 from the first hook 252, as shown in FIG. 11. Such a design does not need screws to fix the cover 1 onto the base 3. Thus, the cover 1 can be quickly fixed onto the base 3 and allows the cover 1 to be quickly unfixed from the base 3.

As a summary, the present invention provides a portable electric inflator that can quickly dissipate the heat generated therein. The portable electric inflator includes an electric air compressor 50 and a box for accommodating the electric air compressor. The box defines therein a generally L-shaped space to accommodate various parts of the air compressor. In operation, the cooling fan 76 can draw outside air into the generally L-shaped space, wherein the airflow can be directed to flow through two openings 710 of the motor 71 to enter the interior of the motor 71 so that the heat generated in the motor can be quickly dissipated. Next, the airflow is guided to the peripheral wall 53 of the main frame 5 of the air compressor 50, which cooperates with the beveled radial braces 54 and the through holes 52 of the main frame 5 to facilitate the airflow to flow through the main frame 5 and thus dissipate the heat generated in the bearing 511 and the transmission mechanism. Thereafter, the airflow is guided by the L-shaped walls to turns at a right angle to reach the cylinder 56, wherein one part of the airflow may flow over the cylinder 56 (the flow path (a)) to dissipate the heat of the cylinder 56; another part of the airflow may flow through the intake channel 750 of the piston body 75 to enter the inner space of the cylinder 56 (the flow path (b)), so that the heat of the cylinder 56 can be dissipated more quickly. With the air compressor and the box, the performance of the inflator can be increased; therefore, the time required for inflating an object can be reduced. In addition, the size of the inflator can be reduced.

I claim:

1. A portable electric inflator including an electric air compressor and a box for accommodating the electric air compressor, the electric air compressor including a main frame, a cylinder fitted with a piston body and provided at the main frame, a motor fitted with a cooling fan at its output axle and mounted to the main frame, the motor rotating the cooling fan and driving a transmission mechanism to have the piston body conduct reciprocating motion in the cylinder, so that compressed air is produced in the cylinder and transferred to an air storage container;

wherein the improvement comprising:

the box defines therein a L-shaped space for accommodating the cooling fan, the motor, the main frame together with the transmission mechanism, the cylinder with the piston body, and the air storage container of the electric air compressor;

an air entrance port is defined at the box, near a front portion of the L-shaped space, and an air exit port is defined at the box, near a rear portion of the L-shaped space;

wherein outside air is drawn by the cooling fan to flow through the air entrance port to enter the box and flow along the L-shaped space and finally discharge into an exterior environment via the air exit port, thus dissipating heat generated by the electric air compressor, wherein the air compressor is installed with a pressure gauge for indicating the pressure of the compressed air produced therein;

the box defines another space separated from the L-shaped space for accommodating the pressure gauge, the box being composed of a cover and a base, wherein the cover is provided with a switch, a transparent window above the pressure gauge, and a plurality of upper snap fasteners, the switch being electrically connected to the electric air compressor for starting or stopping operation of the electric air compressor, the transparent window allowing a user to read the pressure gauge, the box defining at one side a plurality of first slits, which serve as the air entrance port for allowing outside air to enter the L-shaped space, and defining at another side a plurality of second slits, which serve as the air exit port for discharging airflow into the exterior environment; the base is provided with a plurality of lower snap fasteners to be detachably engaged with the upper snap fasteners, so that the cover can be detachably fixed onto the base, wherein the box is rectangular in shape, the base having a flat bottom and four sidewalls including a front base wall, a rear base wall, a right base wall, and a left base wall, the first slits being defined at the front base wall whereas the second slits being defined at the left base wall, the base being provided with a plurality of lower partitioning walls including a first L-shaped base wall, a short straight base wall, an outwardly angled base wall, and a second L-shaped base wall, the first L-shaped base wall being composed of a first straight lower first partitioning wall base part and a second straight lower first partitioning wall base part, the second L-shaped base wall being composed of a first straight lower second partitioning wall base part, a second straight lower second partitioning wall base part, and a curved lower second partitioning wall base part therebetween, the first straight lower first partitioning wall base part of the first L-shaped base wall being joined to the left base wall, the second straight lower first partitioning wall base part of the first L-shaped base wall being joined to the front base wall, the first straight lower second partitioning wall base part of the second L-shaped base wall being joined to the left base wall, one end of the outwardly angled base wall being joined to the second straight lower second partitioning wall base part of the second L-shaped base wall, the short straight base wall being joined between the front base wall and another end of the outwardly angled base wall; wherein the front base wall, the first L-shaped base wall, the left base wall, the second L-shaped base wall, the outwardly angled base wall and the short straight base wall define a lower portion of the L-shaped space;

the front base wall, the left base wall and the first L-shaped base wall defines a lower portion of the space for accommodating the pressure gauge;

the cooling fan is located between the second straight lower first partitioning wall base part of the first L-shaped base wall and the short straight wall;

the motor is located between the second straight lower first partitioning wall base part of the first L-shaped base wall and the outwardly angled base wall;

the main frame together with the transmission mechanism is located near the curved part of the second L-shaped base wall;

the cylinder and the air storage tank are located between the first straight lower first partitioning wall base part of the first L-shaped base wall and the first straight lower second partitioning wall base part of the second L-shaped base wall; the piston is parallel to the first straight lower second partitioning wall base part of the second L-shaped base wall.

2. The portable electric inflator of claim 1, wherein the cover has a flat top and four sidewalls including a front cover wall, a rear cover wall, a right cover wall, and a left cover wall respectively corresponding to the front base wall, the rear base wall, the right base wall, and the left base wall of the base, the first slits being defined at the front cover wall as well as the front base wall, the second slits being defined at the left cover wall as well as the left base wall, the cover being provided with a plurality of upper partitioning walls corresponding to the lower partitioning walls of the base, the upper partitioning wall including a first L-shaped cover wall, a short straight cover wall, an outwardly angled cover wall, and a second L-shaped cover wall, the first L-shaped cover wall being composed of a first straight upper first partitioning wall cover part and a second upper first partitioning wall cover straight part, the second L-shaped cover wall being composed of a first straight upper second partitioning wall cover part, a second straight upper second partitioning wall cover part, and a curved upper second partitioning wall cover part therebetween, the first straight upper first partitioning wall cover part of the first L-shaped cover wall being joined to the left cover wall, the second straight upper first partitioning wall cover part of the first L-shaped wall being joined to the front cover wall of the cover, the first straight upper second partitioning wall cover part of the second L-shaped wall being joined to the left cover wall, one end of the outwardly angled cover wall of the cover being joined to the second straight upper second partitioning wall cover part of the second L-shaped cover wall, the short straight cover wall being joined between the front cover wall of the cover and the other end of the outwardly angled cover;

wherein the front cover wall, the first L-shaped cover wall, the left cover wall, the second L-shaped cover wall, the outwardly angled cover wall and the short straight cover wall define an upper portion of the L-shaped space; the front cover wall, the left cover wall, and the first L-shaped cover wall define an upper portion of the L-shaped space for accommodating the pressure gauge; whereby outside air is drawn by the cooling fan and guided by the short straight walls, the outwardly angled cover wall and the second L-shaped cover wall to sequentially pass the motor, the main frame, the transmission mechanism, the cylinder with the piston body, and the air storage tank of the air compressor, to take away heat generated by parts of the air compressor.

3. The portable electric inflator of claim 1, wherein the cover has a flat top and four sidewalls including a front cover wall, a rear cover wall, a right cover wall, and a left cover wall, the first slits being defined at the front cover wall of the cover whereas the second slits being defined at the left cover wall of the cover, the cover being provided with a plurality of upper partitioning walls including a first L-shaped cover wall, a short straight cover wall, an outwardly angled cover wall, and a second L-shaped cover wall, the first L-shaped cover wall being composed of a first straight upper first partitioning wall cover part and a second straight upper first partitioning wall cover part, the second L-shaped cover wall being composed of a first straight upper second partitioning wall cover part, a second straight upper second partitioning wall cover part, and a curved upper second partitioning wall cover part therebetween, the first straight upper first partitioning wall cover part of the first L-shaped cover wall being joined to the left cover wall, the second straight upper first partitioning wall cover part of the first L-shaped cover wall being joined to the front cover wall, the first straight upper second partitioning wall cover part of the second L-shaped cover wall being joined to the left cover wall, one end of the outwardly angled cover wall being joined to the second straight upper second partitioning wall cover part of the second L-shaped upper wall, the short straight cover wall being joined between the front cover wall and the other end of the outwardly angled upper wall;

wherein the front cover wall, the first L-shaped cover wall, the left cover wall, the second L-shaped upper wall, the outwardly angled cover wall and the short straight cover wall define an L-shaped cover space; the cooling fan is located between the second straight upper first partitioning wall cover part of the first L-shaped upper wall and the short straight wall; the motor is located between the second straight upper first partitioning wall cover part of the first L-shaped cover wall and the outwardly angled cover wall; the main frame together with the transmission mechanism is located near the curved part of the second L-shaped cover wall; the cylinder and the air storage tank are located between the first straight upper first partitioning wall cover part of the first L-shaped cover wall and the first straight upper second partitioning wall cover part of the second L-shaped cover wall; the piston is parallel to the first straight upper second partitioning wall cover part of the second L-shaped cover wall; the front cover wall, the left cover wall and the first L-shaped cover wall define the L-shaped space for accommodating the pressure gauge; whereby outside air is drawn by the cooling fan and guided by the short straight cover wall, the outwardly angled cover wall and the second L-shaped cover wall to sequentially pass the motor, the main frame, the transmission mechanism, the cylinder with the piston body, and the air storage tank of the air compressor, to take away the heat generated by parts of the air compressor.

4. The portable electric inflator of claim 2, wherein the cover is provided with an upper wall behind the front cover wall, between the first L-shaped cover wall and the short straight cover wall, the upper wall having a concave bottom edge; the base is provided with a lower wall behind the front base wall of the base, between the first L-shaped base wall and the short straight base wall of the base, the lower wall having a concave top edge, thus defining a round opening between the upper wall and the lower wall for receiving the cooling fan, the round opening having a dimension slightly greater than the cooling fan, so that turbulence of outside air being drawn into the L-shaped space can be reduced.

5. The portable electric inflator of claim 4, wherein a flat bottom of the base is provided with a lower positioning socket and a lower airflow-guiding member within the L-shaped space, whereas a flat top of the cover is provided with an upper positioning socket and an upper airflow-guiding member within the L-shaped upper space; the motor defines two openings at its surrounding wall and a plurality of downstream through holes at its bottom wall opposite to the cooling fan; the main frame is provided with two protrusions corresponding to the upper and lower sockets; wherein the upper and lower positioning sockets are respectively engaged with the two protrusions to prevent the motor from tilting or turning over; the upper and lower airflow-guiding members respectively have slant surfaces each directed towards one of the two openings of the motor, whereby the airflow drawn by the cooling fan can flow through the openings of the motor to enter an interior of the motor and flow out of the motor via the downstream through holes to dissipate heat generated in the motor.

6. The portable electric inflator of claim 5, wherein the transmission mechanism includes a pinion fitted at the output axle of the motor, a gear engaged with the pinion, and a counterweight provided with a crankshaft and a crankpin and attached to the gear, the main frame defining two axle-supporting portions, one of which is for mounting the motor and another of which is provided with a bearing for mounting the crankshaft provided at the counterweight, the crankpin being pivotally connected to the piston body, the piston body defining an intake channel, which allows the airflow drawn by the cooling fan to flow into the inner space of the cylinder in addition to flowing over the cylinder; the main frame defines two through holes at two opposite sides of the axle-supporting portions, and the main frame has a peripheral wall being partially around the bearing and has a plurality of beveled radial braces provided between the peripheral wall and the axle-supporting portion that holds the bearing to facilitate the airflow to flow through the main frame, thus effectively dissipating heat generated in the bearing and the transmission mechanism; the air storage tank is provided with a plurality of outlets for connecting to different objects.

7. The portable electric inflator of claim 6, wherein the rear base wall defines a lower cutout, the rear cover wall defines an upper cutout, the second L-shaped base wall defines a plurality of third slits at its first straight part, near the second slits of the left base wall, and the second L-shaped upper wall defines a plurality of third slits at its first straight part, near the second slits of the left cover wall, whereby heat generated by the air compressor can be dissipated.

8. The portable electric inflator of claim 7, wherein the cover defines a groove along bottom edges of the front cover wall, the right cover wall, and the left cover wall, whereas the base is provided with a protrusion along top edges of the front cover wall, the right cover wall, and the left cover wall, corresponding to the groove of the cover, wherein the protrusion of the base is capable of being inserting into the groove of the cover to facilitate the cover being fixed onto the base.

* * * * *